US011263860B2

(12) United States Patent
Marks

(10) Patent No.: US 11,263,860 B2
(45) Date of Patent: Mar. 1, 2022

(54) GAMING MACHINES AND METHOD FOR MULTIPLAYER GAME MACHINE DISPLAY

(71) Applicant: ARISTOCRAT TECHNOLOGIES AUSTRALIA PTY LIMITED, North Ryde (AU)

(72) Inventor: Daniel Marks, Decatur, GA (US)

(73) Assignee: Aristocrat Technolgoies Australia Pty Limited, North Ryde (AU)

( * ) Notice: Subject to any disclaimer, the term of this patent is extended or adjusted under 35 U.S.C. 154(b) by 0 days.

(21) Appl. No.: 16/532,177

(22) Filed: Aug. 5, 2019

(65) Prior Publication Data

US 2019/0385402 A1 Dec. 19, 2019

Related U.S. Application Data

(63) Continuation-in-part of application No. 29/653,732, filed on Jun. 18, 2018, now Pat. No. Des. 898,126.

(51) Int. Cl.
*G07F 17/32* (2006.01)
*G07F 17/34* (2006.01)

(52) U.S. Cl.
CPC ..... *G07F 17/3211* (2013.01); *G07F 17/3216* (2013.01); *G07F 17/3227* (2013.01); *G07F 17/3267* (2013.01); *G07F 17/34* (2013.01)

(58) Field of Classification Search
CPC ..... G07F 17/3211; G07F 17/3216; G07F 17/3227; G07F 17/3267
USPC ..... 463/31, 46, 16, 20
See application file for complete search history.

(56) References Cited

U.S. PATENT DOCUMENTS

| | | | | |
|---|---|---|---|---|
| 5,688,174 | A | 11/1997 | Kennedy | |
| D466,161 | S | 11/2002 | Takahashi et al. | |
| D520,068 | S | 5/2006 | Hirato et al. | |
| D521,074 | S | 5/2006 | Hirato et al. | |
| D549,785 | S | 8/2007 | Luciano, Jr. et al. | |
| 7,288,024 | B2 | 10/2007 | Toyoda | |
| 7,311,598 | B2 * | 12/2007 | Kaminkow | G07F 17/32 463/16 |
| 7,311,604 | B2 * | 12/2007 | Kaminkow | G07F 17/32 463/20 |
| D572,770 | S * | 7/2008 | Seelig | G07F 17/3211 D21/370 |
| D579,500 | S | 10/2008 | Luciano, Jr. et al. | |
| 7,465,226 | B2 * | 12/2008 | Ikeya | G07F 17/32 463/16 |
| D595,783 | S | 7/2009 | Anderson | |
| D614,244 | S | 4/2010 | Inoue | |
| D641,047 | S | 7/2011 | Tahara et al. | |
| D646,336 | S | 10/2011 | Kelly et al. | |
| 8,216,046 | B2 * | 7/2012 | Ikeya | G07F 17/3211 463/17 |
| 8,777,719 | B2 * | 7/2014 | Mayeroff | G07F 17/3211 463/20 |
| D714,875 | S | 10/2014 | Wudtke et al. | |
| D715,364 | S | 10/2014 | Wudtke et al. | |
| 9,728,031 | B2 * | 8/2017 | Schultz | G07F 17/3272 |

(Continued)

*Primary Examiner* — Chase E Leichliter
(74) *Attorney, Agent, or Firm* — Armstrong Teasdale LLP

(57) ABSTRACT

An electronic gaming machine is provided. The electronic gaming machine includes a carousel display screen, at least one memory device, and at least one processor in communication with the at least one memory device. The at least one processor is programmed to control the carousel display screen to display a plurality of play areas.

20 Claims, 9 Drawing Sheets

(56) References Cited

U.S. PATENT DOCUMENTS

D877,811 S 3/2020 Bernard
D878,477 S 3/2020 Bernard
D880,605 S 4/2020 Bussey
2003/0148804 A1* 8/2003 Ikeya ..... G07F 17/3211 463/16
2003/0153385 A1* 8/2003 Ikeya ..... G07F 17/34 463/31
2004/0214630 A1* 10/2004 Mayeroff ..... G07F 17/3267 463/20
2005/0164762 A1 7/2005 Smith et al.
2006/0046821 A1* 3/2006 Kaminkow ..... G07F 17/326 463/16
2007/0054723 A1* 3/2007 Mattice ..... G07F 17/3211 463/16
2007/0066387 A1 3/2007 Matsuno et al.
2007/0149292 A1* 6/2007 Kaminkow ..... G07F 17/3211 463/46
2008/0070663 A1 3/2008 Losilevsky
2008/0182662 A1 7/2008 Yoshizawa
2009/0239625 A1 9/2009 Yoshizawa
2011/0165932 A1* 7/2011 Rommerdahl ..... G07F 17/3211 463/17
2011/0287824 A1 11/2011 Schultz et al.
2011/0306402 A1* 12/2011 Van Linden ..... G07F 17/3272 463/20
2012/0122571 A1* 5/2012 DeSimone ..... G07F 17/3211 463/31
2012/0302315 A1* 11/2012 Ikeya ..... G07F 17/32 463/20
2013/0116037 A1* 5/2013 Acres ..... G07F 17/3258 463/23
2016/0086421 A1* 3/2016 Schultz ..... G07F 17/3211 463/31
2019/0102974 A1* 4/2019 Bussey ..... G07F 17/3211
2019/0295362 A1* 9/2019 Pececnik ..... G07F 17/3216
2020/0118379 A1* 4/2020 Danielson ..... G07F 17/3211

* cited by examiner

GAMING MACHINES AND METHOD FOR MULTIPLAYER GAME MACHINE DISPLAY

CROSS REFERENCE TO RELATED APPLICATIONS

This application is a continuation-in-part of and claims priority to U.S. Design Application No. 29/653,732, filed Jun. 18, 2018, entitled "MULTIPLAYER GAME MACHINE DISPLAY," the contents of which are hereby incorporated by reference in their entirety.

TECHNICAL FIELD

The field of disclosure relates generally to electronic gaming, and more particularly to an electronic gaming machine and method of operation thereof that allows for a display that provides for dynamic allocation of multiple games and multiplayer games across multiple connected gaming machines.

BACKGROUND

Electronic gaming machines (EGMs), or gaming devices, provide a variety of wagering games such as, for example, and without limitation, slot games, video poker games, video blackjack games, roulette games, video bingo games, keno games, and other types of games that are frequently offered at casinos and other locations. Play on EGMs typically involves a player establishing a credit balance. When the player is done, he/she cashes out the credit balance (typically by pressing a cash out button to receive a ticket from the ticket printer 222). The ticket may be "cashed-in" for money or inserted into another machine to establish a credit balance for play by inserting or otherwise submitting money and placing a monetary wager (deducted from the credit balance) on one or more outcomes of an instance, or play, of a primary game, sometimes referred to as a base game. In many games, a player may qualify for secondary games or bonus rounds by attaining a certain winning combination or other triggering event in the base game. Secondary games provide an opportunity to win additional game instances, credits, awards, jackpots, progressives, etc. Awards from any winning outcomes are typically added back to the credit balance and can be provided to the player upon completion of a gaming session or when the player wants to "cash out."

Slot games are often displayed to the player in the form of various symbols arranged in a row-by-column grid, or "matrix." Specific matching combinations of symbols along predetermined paths, or paylines, drawn through the matrix indicate the outcome of the game. The display typically highlights winning combinations and outcomes for ready identification by the player. Matching combinations and their corresponding awards are usually shown in a "pay-table" that is available to the player for reference. Often, the player may vary his/her wager to included differing numbers of paylines and/or the amount bet on each line. By varying the wager, the player may sometimes alter the frequency or number of winning combinations, the frequency or number of secondary games, and/or the amount awarded.

Typical games use a random number generator (RNG) to randomly determine the outcome of each game. The game is designed to return a certain percentage of the amount wagered back to the player, referred to as return to player (RTP), over the course of many plays or instances of the game. The RTP and randomness of the RNG are fundamental to ensuring the fairness of the games and are therefore highly regulated. The RNG may be used to randomly determine the outcome of a game and symbols may then be selected that correspond to that outcome. Alternatively, the RNG may be used to randomly select the symbols whose resulting combinations determine the outcome. Notably, some games may include an element of skill on the part of the player and are therefore not entirely random.

Many conventional gaming machines are independent of the other gaming machines that are around them. More specifically, known gaming machines do not include a continuous display that can be configured into multiple gaming stations or can be reconfigured into less gaming stations having a larger display area. Moreover, these known gaming machines do not allow for game play to be displayed on one display area and then moved to another display area where gameplay at one gaming station impacts game play at another gaming station. Furthermore, multiple gaming machines take up space and floor space may be at a premium.

BRIEF DESCRIPTION

In one aspect, an electronic gaming machine is provided. The electronic gaming machine includes a carousel display screen, at least one memory device, and at least one processor in communication with the at least one memory device. The at least one processor executes instructions to determine a current number of play areas based on a plurality of settings and one or more current conditions. The at least one processor further executes instructions to determine a size for each of the play areas based on the current number of play areas. The at least one processor also executes instructions to instruct the carousel display screen to display the current number of play areas at the determined size. In addition, the at least one processor executes instructions to execute a plurality of wagering games in the play areas on the carousel display screen.

In another aspect, a method of controlling a carousel electronic gaming machine is provided. The method is executed by a game controller. The carousel electronic carousel gaming machine includes a circular display that displays images for 360 degrees around the electronic gaming machine. The game controller is in communication with the circular display. The method includes determining a current number of play areas based on a plurality of settings and one or more current conditions. The method also includes determining a size for each of the play areas based on the current number of play areas. The method further includes instructing the circular display to display the current number of play areas at the determined size. In addition, the method includes executing a plurality of wagering games in the play areas on the circular display.

BRIEF DESCRIPTION OF THE DRAWINGS

An example embodiment of the subject matter disclosed will now be described with reference to the accompanying drawings.

DETAILED DESCRIPTION

In the exemplary embodiment, a plurality of electronic gaming machines (EGM) are connected together in a carousel with a continuous display. In the exemplary embodiment, the plurality of EGMs are connected in a circular configuration, where a single, continuous display screen connects the plurality of EGMs. The carousel EGM allows for a dynamic number of play positions to be allocated. For example, the carousel EGM could be configured with six (6) play positions or play stations at peak play times and be dynamically reconfigured to three (3) play positions during slower times. Furthermore, the three play positions may have increased displayed size or play area on the display compared to the six position configuration. In addition, the carousel EGM may include multiplayer standard and bonus games, where the images on the display screen move from one play area to another, and where multiple players may interact based on the game or bonus game. The number of play areas and corresponding sizes may be based on settings from an operator of the carousel EGM. The number of play areas and sizes may be adjusted based on time, date, number of active players, and other settings that the operator desires. Furthermore, shared bonus games could affect all of the players or even cause one player's actions to affect the games of other players.

Figure 1:
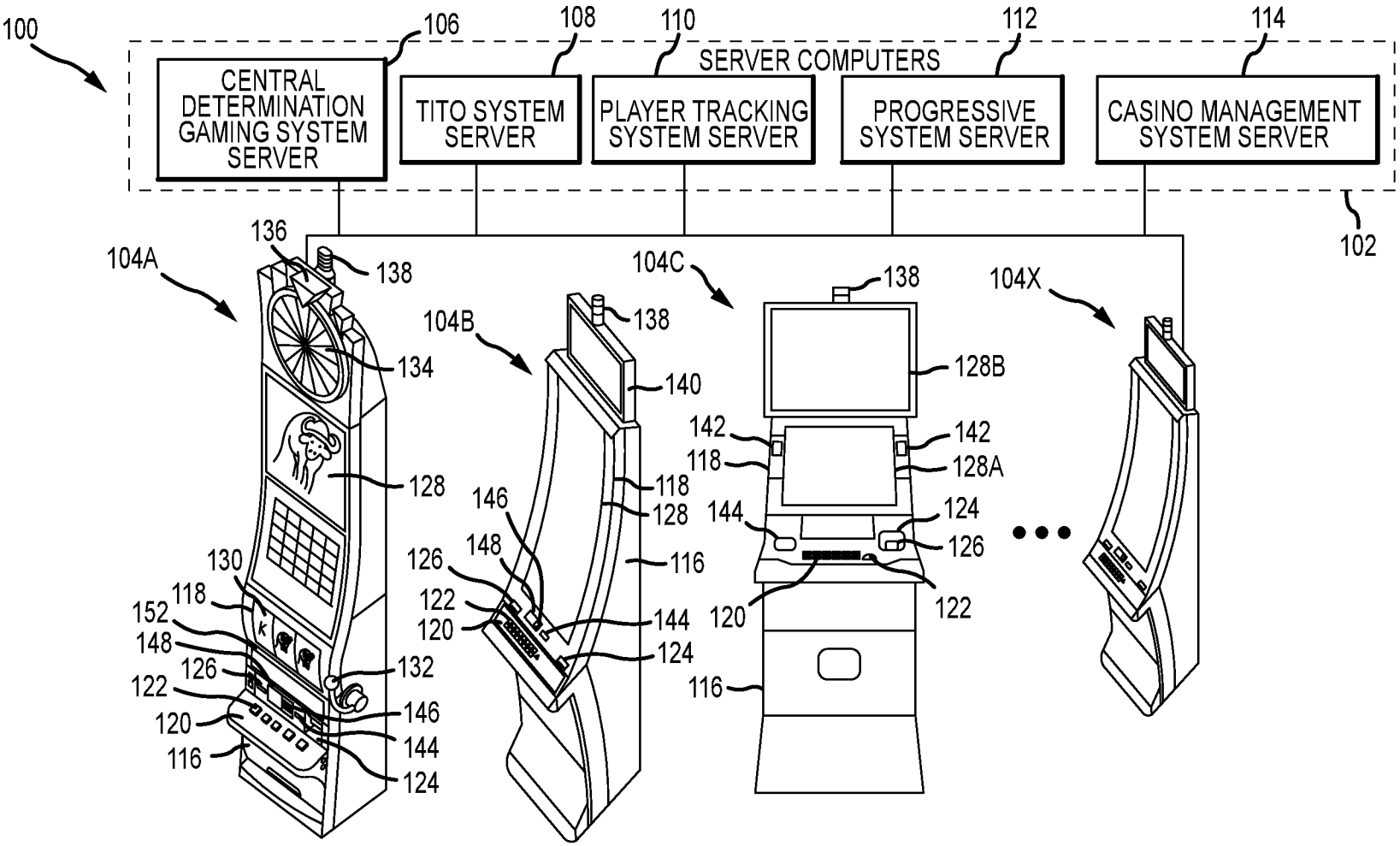
FIG. 1 is an exemplary diagram showing several EGMs networked with various gaming related servers.

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console, although such devices may require specialized software and/or hardware to comply with regulatory requirements regarding devices used for wagering or games of chance in which monetary awards are provided.

Communication between the gaming devices 104A-104X and the server computers 102, and among the gaming devices 104A-104X, may be direct or indirect, such as over the Internet through a web site maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, in one or more embodiments, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server 106 and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 154 which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are well known in the art and are used to generate and track unique bar-codes or other indicators printed on tickets to allow players to avoid the use of bills and coins by loading credits using a ticket reader and cashing out credits using a ticket-out printer 126 on the gaming device 104A. The gaming machine 104A can have hardware meters for purposes including ensuring regulatory compliance and monitoring the player credit balance. In addition, there can be additional meters that record the total amount of money wagered on the gaming machine, total amount of money deposited, total amount of money withdrawn, total amount of winnings on gaming device 104A.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Figure 2:
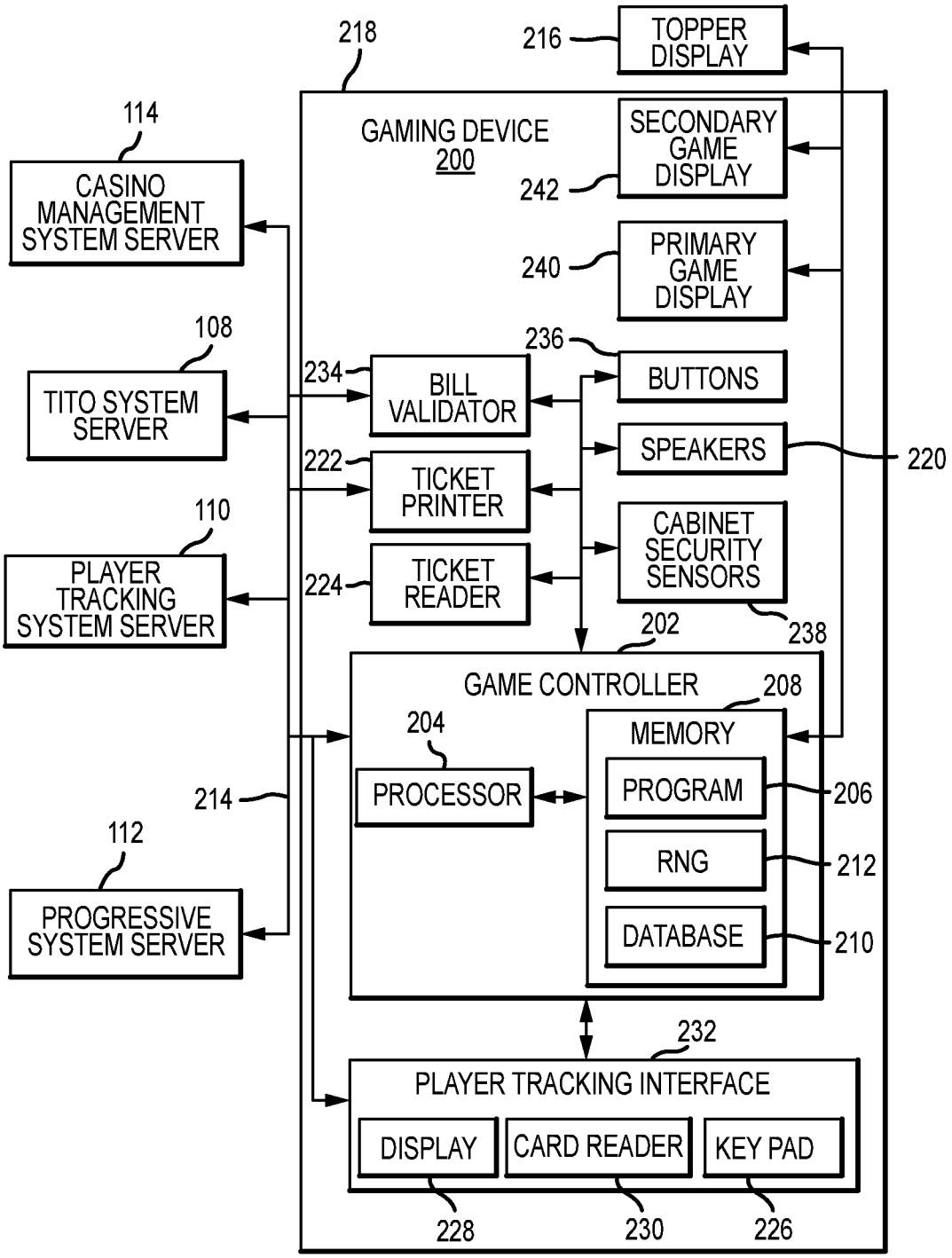
FIG. 2 is a block diagram showing various functional elements of an exemplary EGM as shown in FIG. 1.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc® model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 154 which opens to provide access to the interior of the gaming device 104B. The main or service door 154 is typically used by service personnel to refill the ticket-out printer 126 and collect bills and tickets inserted into the bill validator 124. The main or service door 154 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator. In some embodiments, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

FIG. 2 is a block diagram depicting exemplary internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

Alternatively, a game instance (i.e., a play or round of the game) may be generated on a remote gaming device such as a central determination gaming system server 106 (not shown in FIG. 2 but see FIG. 1). The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server 106 to memory 208. The memory 208 may include RAM, ROM or another form of storage media that stores instructions for execution by the processor 204. Note that embodiments of the present disclosure represent an improvement in the art of EGM software and provide new technology in that they control multiple interconnected EGMs to coordinate a background display over the interconnected EGMs. These embodiments are thus not merely new game rules or simply a new display pattern.

The gaming device 200 may include a topper display 216 or another form of a top box (e.g., a topper wheel, a topper screen, etc.) which sits above cabinet 218. The cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. Ticket printer 222 may be used to print tickets for a TITO system server 108. The gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g., amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gamine machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a cash out button to receive a ticket from the ticket printer 222). The ticket may be "cashed-in" for money or inserted into another machine to establish a credit balance for play.

Figure 3:
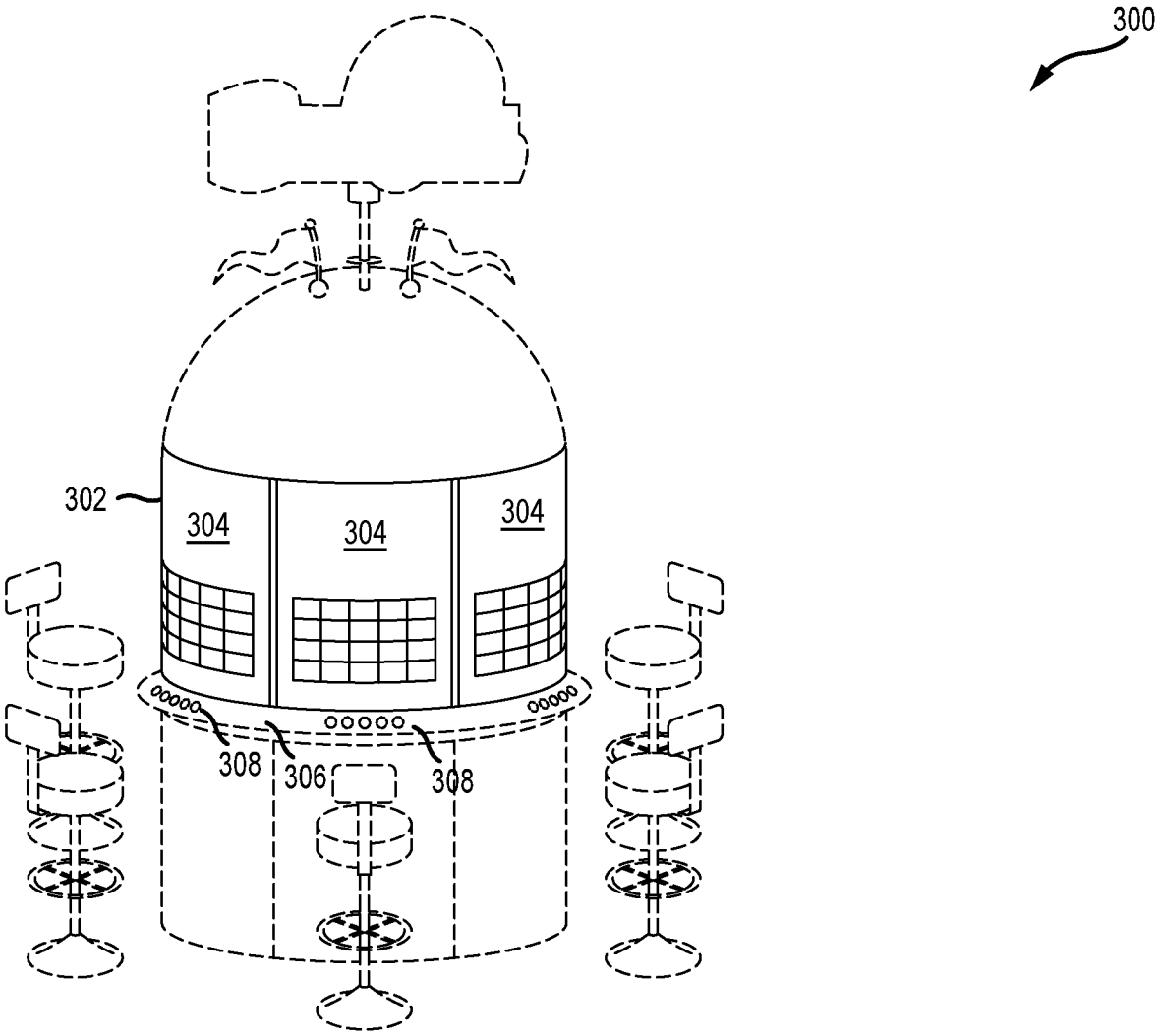
FIG. 3 is an exemplary diagram showing a carousel EGM in accordance with one embodiment of this disclosure.
Figure 4:
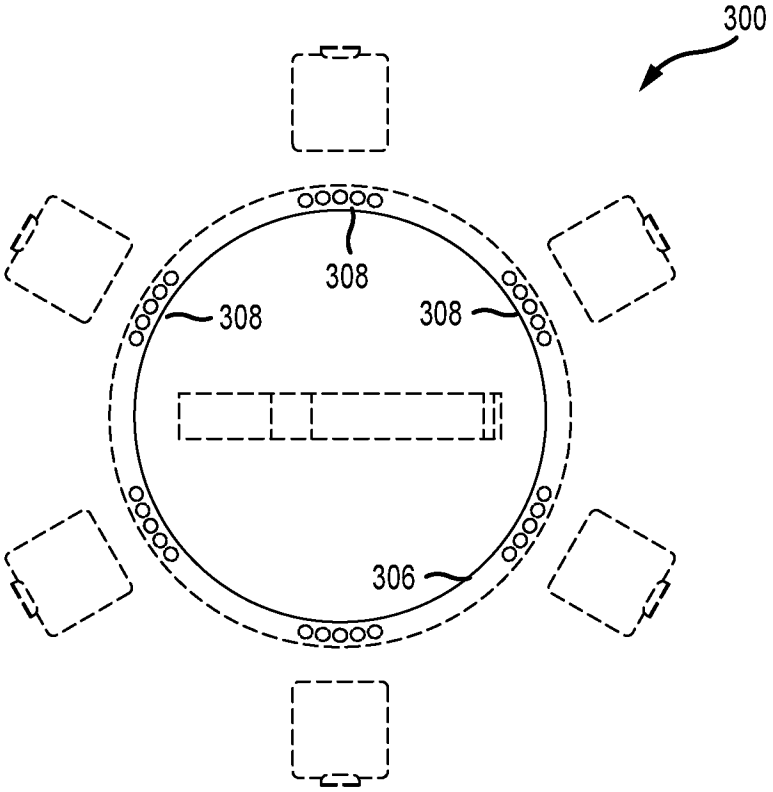
FIG. 4 is a top view of the carousel EGM shown in FIG. 3.

FIG. 3 is an exemplary diagram showing a carousel EGM 300 in accordance with one embodiment of this disclosure. FIG. 4 illustrates a top view of the carousel EGM 300 shown in FIG. 3. In some embodiments, EGM 300 includes similar attributes and functions to gaming device 200 shown in FIG. 2 or gaming devices 104A-104X.

In the exemplary embodiment, the carousel EGM 300 includes a single, continuous display screen 302. In some embodiments, the carousel display screen 302 is a single piece of material with a single cured display unit behind it, or multiple display units behind it. For example, one or more projectors inside of the carousel EGM 300 may project images onto the display screen 302. In other embodiments, the carousel display screen 302 includes a plurality of smaller display screens that are fitted together or possibly adjacent to one another to create the continuous display screen 302. In some embodiments, the display screen 302 is a high-resolution LCD with LED backlighting. In other embodiments, the display screen 302 is a plasma, LED, or OLED panel. The display screen 302 may be convex as shown in FIGS. 3-6 and 8. This allows the display screen to be viewed at a plurality of angles.

In the exemplary embodiment, the display screen 302 displays a plurality of play areas 304. Each play area 304 defines a play station that allows a player to play a game, such as a wagering game described herein. In some embodiments, play area 304 may include both primary game display 240 and secondary game display 242 (both shown in FIG. 2). In some embodiments, the play area 304 and the background images and animations are coordinated and controlled separately, such as with Picture-in-Picture. In these embodiments, changes to the background images animations might not affect the play area 304 and the background images and animations may be independent of the gameplay.

The carousel EGM 300 also includes a shelf 306 with interactive consoles 308 positioned on a shelf 306. The interactive consoles 308 may include one or more features to allow a player to play a wagering game, such as, but not limited to, buttons 236, a bill validator 234, ticket printer 222, and a ticket reader 224 (all shown in FIG. 2). In some other embodiments, the interactive consoles 308 and the shelf 306 may include a display screen, wherein the interactive console 308 is a picture-in-picture display or a cut-out section, so that images and animations may be displayed on the display on the display screen of the shelf 306. Furthermore in these embodiments, the interactive consoles 308 may be moved or displayed on the shelf display screen at different positions around the carousel EGM 300. For example, the display screen on the shelf 306 may reconfigure from six play positions with six interactive consoles to four play positions with four interactive consoles. Thus interactive consoled 308 would change from six such consoles being displayed to four such consoles being displayed.

In the exemplary embodiment, the carousel EGM 300 allows for a plurality of players to play games, simultaneously, where each player may be playing different games of the same game type or different games of different game types. The carousel EGM 300 is configured to dynamically allocate play areas 304 to players. This may include situations where there are fewer play areas 304 and where the play areas 304 are spread out from each other to allow for player privacy. In these situations, the individual play areas 304 may be larger sized to fill up more of the available space on the display screen 302. In other situations, there may be more play areas 304 where the play areas 304 are grouped more closely together. For example, at some times, such as in slow periods, there may only be three play areas 304, where each is evenly spaced around the carousel EGM 300. In other times, such as peak times, there may be six play areas 304. In some embodiments, the carousel EGM 300 adjusts the number of play areas 304 based on at least one of time of day, date, and a number of play areas 304 currently being used. In other embodiments, there may be even more play areas 304 based on the size of the carousel EGM 300. In some embodiments, multiple play areas 304 may be positioned so that an individual player may play more than one game simultaneously.

In some embodiments, players playing different games in different play areas 304 of carousel EGM 300 may interact with each other. This may be where the players on the play areas 304 are playing different instances of the same game or different games entirely. For example, a wheel or other bonus element may be placed in between two adjacent play areas 304 that affects both the games being played in each play area 304, where the bonus element may award the same bonus or different bonuses to the adjacent play areas 304. In another embodiment, a row or column in a first play area 304 may be moved to a different play area 304. For example, the top row of each play area 304 may move one or more play areas 304 around the display screen 302, for example to the left or the right and be evaluated for winning conditions in the new play area 304.

In another embodiment, the carousel EGM 300 may host a head to head or competitive game that allows the different players at the different play areas 304 to compete directly against each other. For example, the carousel EGM 300 may host a tournament where each player gets a number of free spins. The carousel EGM 300 may allow each player to spin one or more times and then rotate the play areas 304 to different positions, so that each player is playing on someone else's play area 304. In this example, the player wins if they outperform the other players.

In still other embodiments, the display screen 302 displays shared bonus games. For example, in one bonus games as (shown in FIG. 8), the display screen may show a large series of bars, each with a prize. The bars may spin around the display screen and the player may win based on the bar that their play area 304 is pointing to. In another example, each play area 304 may show one or more virtual balls coming out of a virtual hopper. The player may then win a bonus based on the ball that lands in their play area. Another example bonus may be where an image rotates around the display screen 302 from play area 304 to play area 304, for example a fish or a flying saucer. If the player gets a specific combination of symbols while the image is in or near their play area 304, they receive a bonus or access to a bonus game.

In some embodiments, the continuous display screen 302 may be used in attract mode. In this mode, the continuous display screen 302 may display bonus information, advertising, or promotional information. For example, the display screen 302 may display an advertisement for a nearby restaurant and point to the restaurant. Some of the promotional information may be tailored to the individual players that are actively playing the EGM 300. In some of these embodiments, the bonus information, advertisement, or promotional information may be provided by a separate server, such as the casino management system server 114 (shown in FIG. 1). In some embodiments, the advertising may be targeted towards the player at the machine, who may be identified via the player reward card. In some further embodiments, attract mode may be used while one or more players are playing on the carousel EGM 300. For example, one or more players may be playing in play areas 304 on one side of the carousel EGM 300, while the other side of the carousel EGM 300 is in attract mode. In another example, a carousel EGM 300 may be in attract mode with no players. Then a player begins playing at a play area 304 on the carousel EGM 300. The carousel EGM 300 allocate a portion of the display screen 302 to the play area 304 of the player while continuing the attract mode on the display screen 302 while the player is playing on the play area 304. In some embodiments, the carousel EGM 300 may discontinue attract mode when a second player begins playing.

In some embodiments, the display screen 302 is divided up into multiple sections in addition to the section dedicated to the play area 304. For example, a first section may display progressive jackpot information provided from a remote gaming server 102 (shown in FIG. 1) associated with the progressive jackpot. Another section may show advertising from an advertising server 102, which may be associated with the casino, or location of the EGM, or the advertising server 102 may provide more general advertisements. A different section may show images or animations associated with the theme of the EGM. Any of these sections may flow around the display screen 302. For example, the progressive jackpot numbers may rotate around the display screen 302 above all of the play areas 304.

Figure 5:
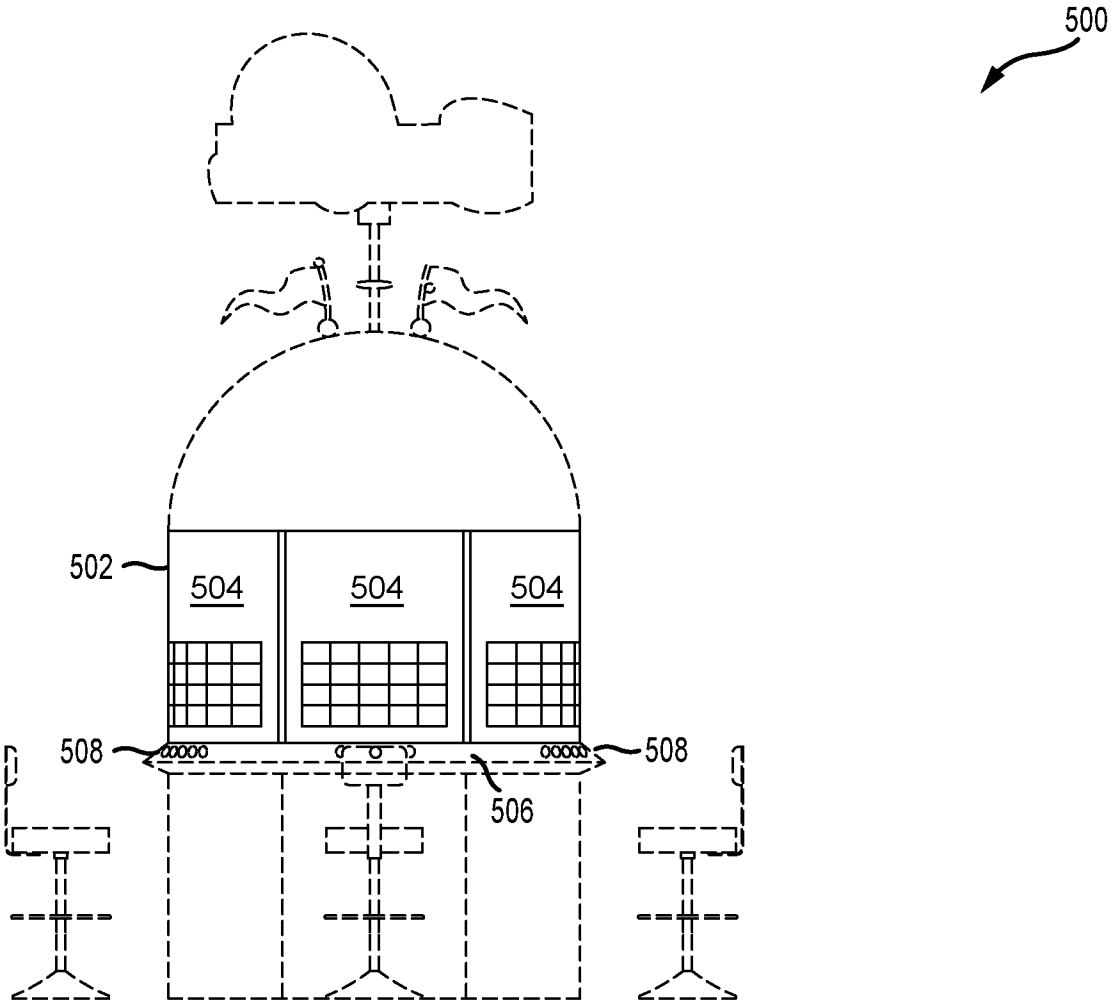
FIG. 5 is an exemplary diagram showing an exemplary four player configuration of the carousel EGM as shown in FIG. 3 in accordance with one embodiment of this disclosure.

FIG. 5 is an exemplary diagram showing an exemplary four player configuration 500 of the carousel EGM 300 as shown in FIG. 3 in accordance with one embodiment of this disclosure. In configuration 500, four play areas 504 are displayed in display screen 502. Each play area 504 includes a corresponding interactive console 508 on shelf 506. Each play area 504 is evenly spaced around display screen 502.

Figure 6:
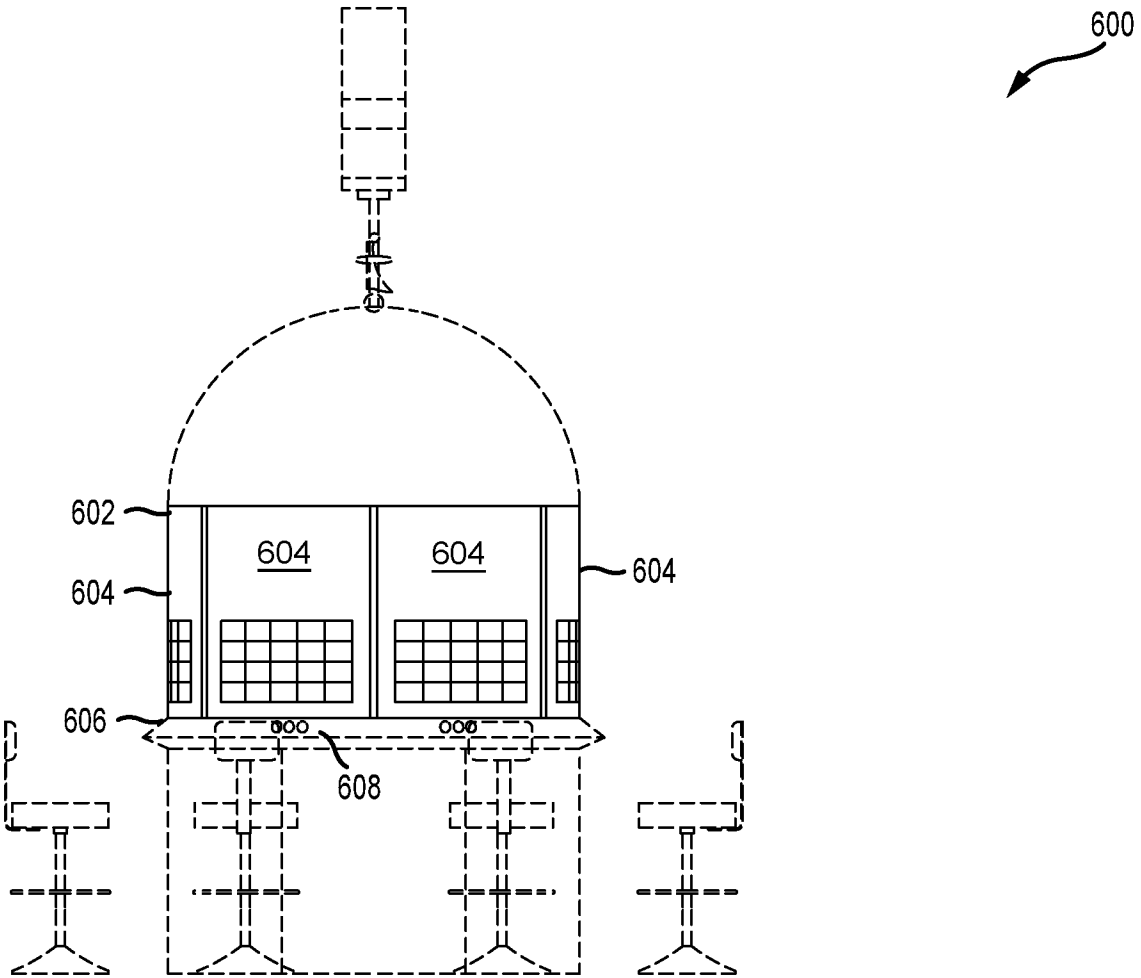
FIG. 6 is an exemplary diagram showing an exemplary six player configuration of the carousel EGM as shown in FIG. 3 in accordance with one embodiment of this disclosure.

FIG. 6 is an exemplary diagram showing an exemplary six player configuration 600 of the carousel EGM 300 as shown in FIG. 3 in accordance with one embodiment of this disclosure. In configuration 600, six play areas 604 are displayed in display screen 602. Each play area 604 includes a corresponding interactive console 608 on shelf 606. Each play area 604 is evenly spaced around display screen 602.

In the exemplary embodiment, carousel EGM 300 is configured to switch back and forth between configuration 500 and configuration 600. While only two configurations are shown, the carousel EGM 300 is also configured to change to other configurations based on the diameter of the carousel EGM 300 and the amount of play space allocated to each player.

While carousel EGM 300 is shown as a circle in FIGS. 3-6 and 8, other shapes, carousel EGM 300 is capable of being created using other shapes, such as, but not limited to, ovals, squares, rectangles, and triangles, for example. Accordingly, the carousel display screen 302 may be circular, square, straight, triangular, concave, convex, or any other shape.

Figure 7:
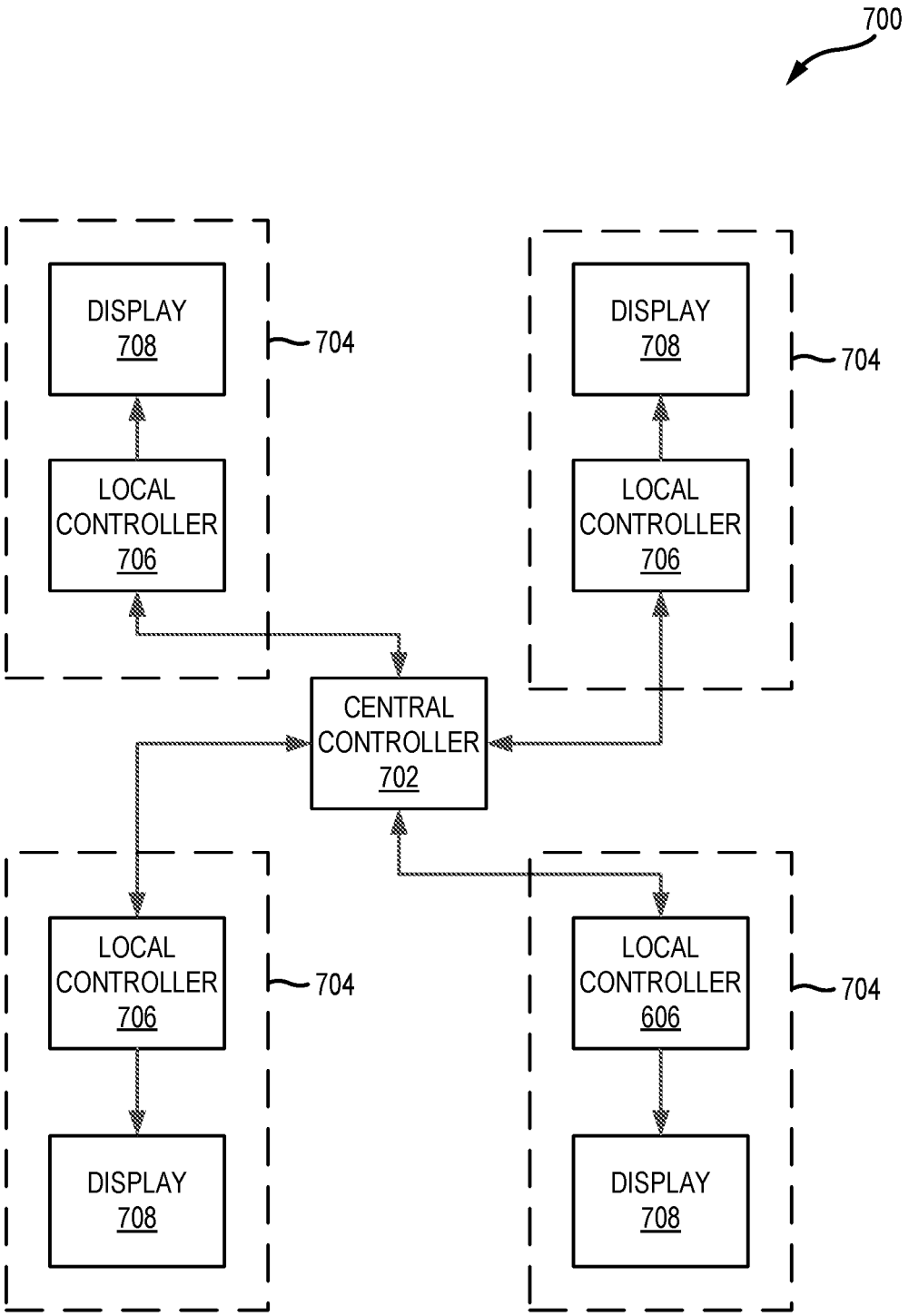
FIG. 7 is a block diagram showing various functional elements of an example of an exemplary configuration of the carousel EGM as shown in FIG. 3.

FIG. 7 is a block diagram showing various functional elements of an example of an exemplary configuration 700 of the carousel EGM 300 as shown in FIG. 3. In this embodiment, the carousel EGM is functionally divided into four portions 704, which are connected to a central controller 702. Each portion 704 includes a local controller 706 that controls a section of display 708, which may be similar to display screen 302 (shown in FIG. 3). In some embodiments, each local controller 706 may also be in communication with one or more interactive consoles 308 (shown in FIG. 3).

In some embodiments, the central controller 702 is configured to instruct the local controllers 706 on how to display their portion of the display screen 302. In these embodiments, the central controller 702 coordinates the locations of the different pixels and objects in the background including any animations. Then the central controller 702 determines which portion 704 is to display which objects and/or pixels and instructs the local controller 706 what to display in the various corresponding section of display 708. In some of these embodiments, the local controller 706 executes the wagering game and instructs the section of display 708 how to display the wagering game, while receiving the information from the central controller 702 on the information to display for the background area of the section of display 708. In other embodiments, the central controller 702 also controls the gameplay of each of the portions 704 and the local controller 706 handles interpreting the instructions from the central controller 702 to be display on the corresponding section of display 708.

In some embodiments, central controller 702 may be one of, or at least in communication with one of, casino management system 114, TITO system server 108, player tracking system 110, and progressive system server 112 (all shown in FIG. 1). For example, central controller 702 may receive information from progressive system server 112 to display and the central controller 702 then integrates that information into the display screen 302. In some further embodiments, the central controller 702 and a separate server 102 each control different portions of the display screen 302. For example, an advertising server (not shown) may control a top section of the display screen 302 and the central controller 702 controls the rest of the display screen 302. In still further embodiments, the central controller 702 shares control of the rest of the sections of display 708 with the local controllers 706. In some embodiments, central controller 702 may be game controller 202 (shown in FIG. 2). In some embodiments, local controller 706 may be game controller 202 (shown in FIG. 2). In some embodiments, sections of display 708 may include both primary game display 240 and secondary game display 242.

While only four local controllers 706 are shown in FIG. 7, one skilled in the art would understand that any number of local controllers 706 may be connected to one or more central controllers 702 to coordinate the images being displayed and the games being played on the various sections of displays 708.

In some embodiments, the central controller 702 is physically located near or in the carousel EGM 300. In other embodiment, the central controller 702 is remote from the carousel EGM 300 and communicates with the carousel EGM 300 via a wired or wireless connection, such as through a local area network (LAN).

In other embodiments, a single central controller 702 may control display screen 302, play areas 304, and interactive consoles 308.

Figure 8:
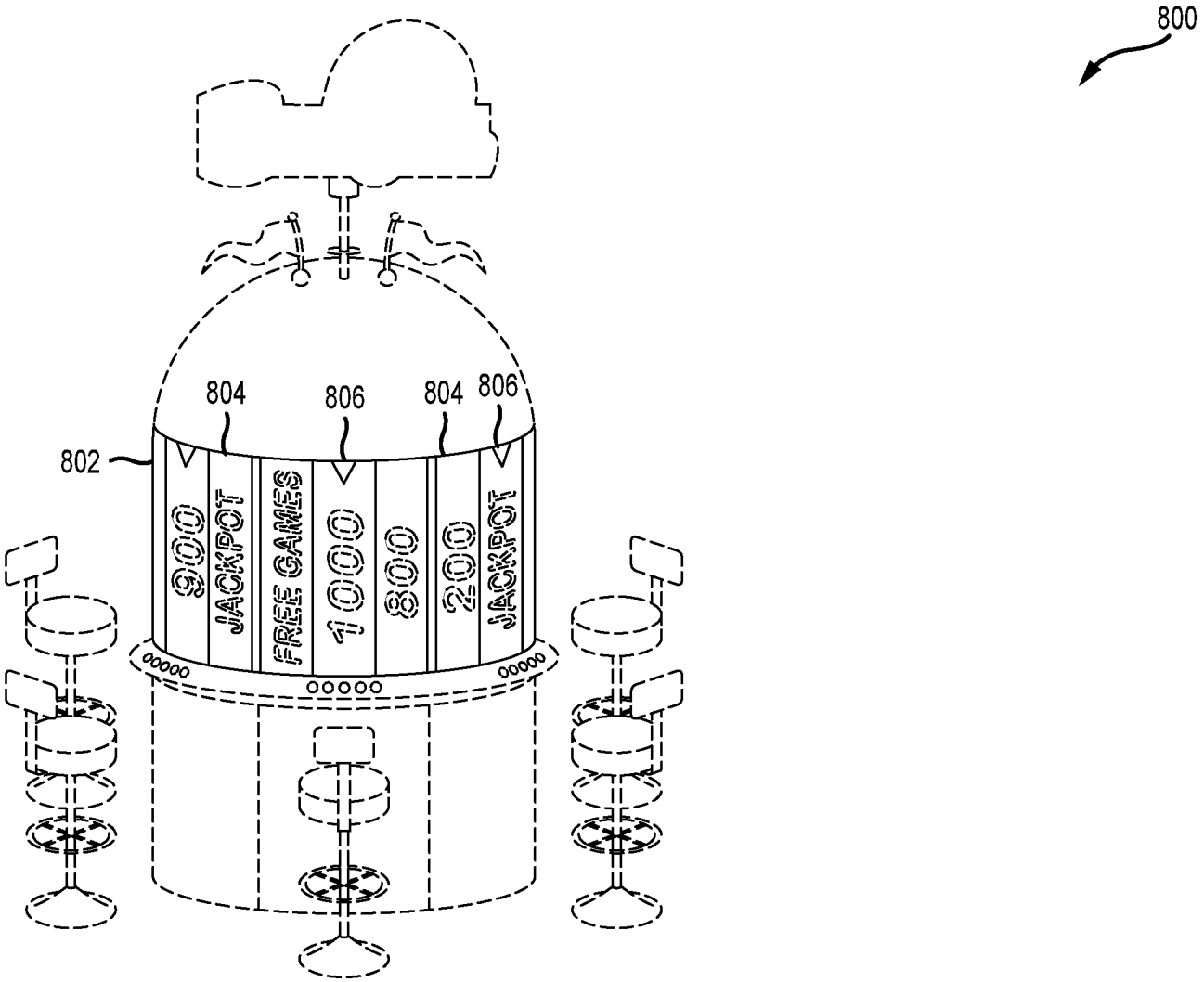
FIG. 8 is an exemplary diagram of the carousel EGM shown in FIG. 3 during an exemplary multiplayer bonus game, in accordance with one embodiment of this disclosure.

FIG. 8 is an exemplary diagram 800 of the carousel EGM 300 shown in FIG. 3 during an exemplary multiplayer bonus game, in accordance with one embodiment of this disclosure. In this embodiment, display screen 802 is covered in a plurality of vertical bars 804, where each bar has a prize or other award on it. In the exemplary embodiment, the bars 804 are rotated around the display screen 802 of the carousel EGM 300. When the bars 804 stop moving, the player may win a prize or award based on the vertical bar 804 associated with the player's pointer 806.

In some embodiments, the plurality of vertical bars 804 are part of a shared bonus game. In some embodiments, the shared bonus game is triggered by a game play event at a single play area 304 (shown in FIG. 3). In other embodiments, the shared bonus game is triggered when there are a minimum number of play areas 304 occupied by players with a game play event at one or more of the play areas 304. In these embodiments, one or multiple players are required to qualify for the bonus game. The bonus game may be for all of the players at the carousel EGM 300 or for only those players that have qualified. The bonus game may be triggered when a minimum number of players have qualified or the bonus game may be triggered a specific period of time after the minimum number of players have qualified. In other embodiments, the shared bonus game is automatically triggered on a periodic basis. The periodic basis may change based on date and time to generate interest in the game when foot traffic nearby is high.

In some embodiments, the game play event by which a player may qualify for the bonus game by getting a specific combination of symbols on a base or bonus game, exceeding a specific period of time playing on the carousel EGM 300, exceeding a threshold of amount played, and exceeding a minimum bet threshold for a period of time.

Figure 9:
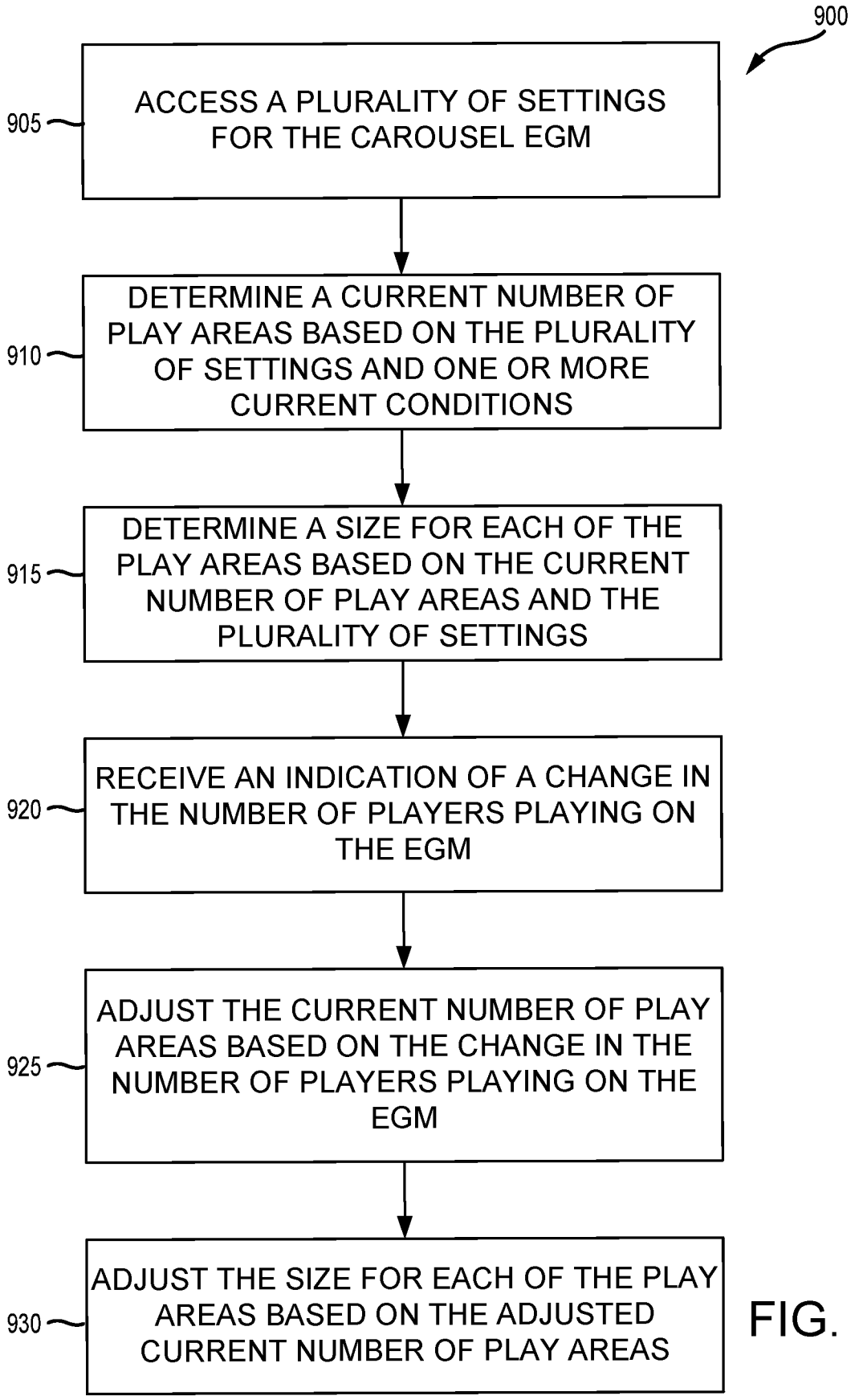
FIG. 9 is a process for dynamically adjusting and allocating play areas on the carousel EGM shown in FIG. 3.

FIG. 9 is a process 900 for dynamically adjusting and allocating play areas 304 (shown in FIG. 3) on the carousel EGM 300 (shown in FIG. 3). In the exemplary embodiment, the number of play areas 304 may be dynamically allocated and sized on the display unit(s) forming the carousel EGM 300 based on multiple factors including, but not limited to player demand, current number of players, time of day, date, amount of turn over, as well as multiple preferences that may be set by the operator of the carousel. In the exemplary embodiment, process 900 is performed by the central controller 702 (shown in FIG. 7) or game controller 202 (shown in FIG. 2).

In the exemplary embodiment, the central controller 702 accesses 905 a plurality of settings for the carousel EGM 300. These settings may include, but are not limited to, numbers of play areas 304 at different times of day or dates, sizing setting for the play areas 304, attract mode settings, advertising settings, jackpot display setting, minimum play area size, maximum play area size, relative play area sizes, minimum and maximum number of play areas, and any other setting needed to operate the carousel EGM 300 as described herein. Some of the settings may be set by the operator of the carousel. Some of the settings may be set by, or stored by, the central determination gaming system server 106, the player tracking system server 110, the progressive system server 112, and the casino management system server 114 (all shown in FIG. 1). In the exemplary embodiment, the central controller 702 has at least read-access to all of the settings for the corresponding carousel EGM 300. The central controller 702 may provide an operator interface to allow an operator to set, view and edit these plurality of settings. The operator interface may be accessible by physically accessing an input device and output device in communication with the central controller 702 or over a network.

In the exemplary embodiment, the central controller 702 determines 910 a current number of play areas 304 to display on the carousel EGM 300 based on the plurality of stored settings and one or more current conditions. The current conditions may include, but are not limited to, number of current players, the current time, the current date, events occurring at the casino, the loyalty status of the players currently playing, and any other condition that may affect demand for the carousel EGM 300.

The central controller 702 determines 915 the size for each of the play areas 304 based on the determined current number of play areas 304 and the plurality of settings and/or current conditions. For example, at three AM on a Tuesday the number of play areas 304 may be set to three, as that is a slow time for that casino. At 10 PM on a Saturday the number of play areas 304 may be set to eight as that is a busy time for that casino. Accordingly, the size of each of the play areas 304 would be different based on the settings. To accommodate 8 players, the individual play areas 304 would be smaller, while the play areas 304 could be larger if there are only three active play areas 304. In certain embodiments, when the maximum number of play areas is set to a specific number, central controller 702 may only display a number of play areas less than or equal to the number set. When additional players approach and begin a play session, the number of play areas may be increased as long as it has not reached the limit.

In the exemplary embodiment, the central controller 702 receives 920 an indication of a change in the number of players. For example, there are currently four play areas 304 and currently three active players. The central controller 702 receives 920 an indication that a fourth player has started playing. In some embodiments, this is based on the central controller 702 receiving an indication that the player has entered a ticket or otherwise provided funds to play the wagering game. The central controller 702 adjusts 925 the current number of play areas 304 based on the change in the number of players playing on the carousel EGM 300. In this example, the central controller 702 may increase the number of play areas to five or six to allow more players to play on the carousel EGM 300. If there are no available play areas 304, players will not try to join in. However, if the central controller 702 attempts to keep the EGM 300 always displaying at least one unoccupied play area 304, then the additional players may occupy the available play area 304. For each carousel EGM 300, there is a practical maximum number of players and play areas 304. This setting may be based on the size of the carousel EGM 300 and may be set by the operator in the plurality of settings.

In the exemplary embodiment, the central controller 702 adjusts 930 the size of each of the current play areas 304. In another example, if a player stops playing on the EGM 300, the central controller 702 may remove 925 one or more of the play areas 304 and readjust 930 the size of the remaining play areas 304. In some embodiments, the sizes of the play areas 304 depend on the number of active play areas 304. In some embodiments, the size of the play area 304 is set for each number of player areas. These sizes may be stored in the settings. For example, when there are four active play areas 304, each of the play areas is a first predetermined size. When the number of active play areas 304 increases to 5, then each of the five play areas area reduced to a second predetermined size.

In one embodiment, the carousel EGM 300 may be used for a gaming tournament where the number of play areas 304 decrease as players are removed from the tournament. In this embodiment, when a player is removed from the tournament, their play area 304 is removed and the remaining play areas 304 are increased in size. This increase in size may be proportional based on the new number of play areas 304.

In one embodiment, during a tournament, the play areas 304 may be adjusted in size by how the corresponding player is doing in the tournament. For example, the play area 304 of the leader of the tournament may be largest play area 304, while the second place player may have the second largest play area 304. As different players move up and down the rankings in the tournament, their play areas 304 may be adjusted in relative size.

In another embodiment, the play area 304 size may dynamically adjust based what is happening in a particular game, such as if the player is winning or is getting closer to a bonus game. As the player reaches each threshold to activate the bonus game, the player's play area 304 increases in size. The play area 304 may also increase in size when the player wins a jackpot. In other embodiments, the play area 304 may change in size when the player gets a specific combination of symbols. In these embodiments, the play area 304 may increase in size for bonus play or in response to some other stimulus and then shrink back down to regular size during regular play.

In at least one embodiment, the steps of process 900 may be stored on a computer readable media for execution by one or more processors.

One or more of the advantages of the system described herein include, but are not limited to, a) providing dynamic allocation of play space to meet player demands; b) dynamically screen size adjustment to allow for appropriate sizing based on the number of play areas allocated; c) improved user experience with the games; d) improved game mechanics by tying gameplay of multiple games together; e) improved allocation of floor space; and f) improve ability to attract players based on improved visibility of play areas.

A computer, controller, or server, such as those described herein, includes at least one processor or processing unit and a system memory. The computer, controller, or server typically has at least some form of computer readable non-transitory media. As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits "configured to" carry out programmable instructions, and these terms are used interchangeably herein. In the embodiments described herein, memory may include, but is not limited to, a computer-readable medium or computer storage media, volatile and nonvolatile media, removable and non-removable media implemented in any method or technology for storage of information such as computer readable instructions, data structures, program modules, or other data. Such memory includes a random access memory (RAM), computer storage media, communication media, and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

As indicated above, the process may be embodied in computer software. The computer software could be supplied in a number of ways, for example on a tangible, non-transitory, computer readable storage medium, such as on any nonvolatile memory device (e.g., an EEPROM). Further, different parts of the computer software can be executed by different devices, such as, for example, in a client-server relationship. Persons skilled in the art will appreciate that computer software provides a series of instructions executable by the processor.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. An electronic gaming machine comprising:

a carousel display screen;

at least one memory device; and at least one processor in communication with the at least one memory device, wherein the at least one processor executes instructions to:

determine a current number of play areas based on a plurality of settings and one or more current conditions;

determine a size for each of the play areas based on the current number of play areas;

instruct the carousel display screen to display the current number of play areas at the determined size;

execute a plurality of wagering games in the play areas on the carousel display screen; and display a shared bonus game element on the carousel display screen in between adjacent ones of the play areas, wherein the shared bonus game element determines a bonus of each of the adjacent ones of the play areas.

2. The electronic gaming machine in accordance with claim 1, wherein the at least one processor further executes instructions to execute a different wagering game at each of the adjacent ones of the play areas.

3. The electronic gaming machine in accordance with claim 1, wherein the shared bonus game element is configured to award a same or a different bonus to the adjacent ones of the play areas.

4. The electronic gaming machine in accordance with claim 1, wherein the at least one processor further executes instructions to:

receive an indication of a change in a current number of active players; and adjust the current number of play areas displayed on the carousel display screen, wherein adjusting includes increasing and decreasing the number of play areas.

5. The electronic gaming machine in accordance with claim 4, wherein the at least one processor further executes instructions to adjust the number of play areas based on at least one of time of a current time, a current date, and a current number of active players.

6. The electronic gaming machine in accordance with claim 1, wherein the at least one processor further executes instructions to adjust the size of each of the play areas based on the current number of play areas.

7. The electronic gaming machine in accordance with claim 1 further comprising a second display screen that encircles the electronic gaming machine, wherein the at least one processor further executes instructions to display a plurality of interactive consoles on the second display screen, wherein each interactive console of the plurality of interactive consoles corresponds to a play area of the plurality of play areas.

8. The electronic gaming machine in accordance with claim 1, wherein the at least one processor further executes instructions to adjust the size of one of the play areas based on an in-game event.

9. The electronic gaming machine in accordance with claim 1, wherein the at least one processor further executes instructions to execute a bonus game on the carousel display screen, wherein the bonus game affects each active play area of the plurality of play areas.

10. A method of controlling a carousel electronic gaming machine, the method executed by a game controller, wherein the carousel electronic gaming machine includes a circular display that displays images for 360 degrees around the carousel electronic gaming machine, wherein the game controller is in communication with the circular display, the method comprising:

determining a current number of play areas based on a plurality of settings and one or more current conditions;

determining a size for each of the play areas based on the current number of play areas;

instructing the circular display to display the current number of play areas at the determined size;

executing a plurality of wagering games in the play areas on the circular display; and displaying a shared bonus game element on the circular display in between adjacent ones of the play areas, wherein the shared bonus game element determines a bonus of each of the adjacent ones of the play areas.

11. The method in accordance with claim 10, wherein the one or more current conditions include at least one of a current time, a current date, and a current number of active players.

12. The method in accordance with claim 10 further comprising:

receiving an indication of a change in a current number of active players; and adjusting the current number of play areas based on the change in the current number of active players.

13. The method in accordance with claim 12, wherein the indication indicates an increase in the current number of active players, and wherein the method further comprises increasing the current number of play areas.

14. The method in accordance with claim 12, wherein the indication indicates a decrease in the current number of active players, and where the method further comprises decreasing the current number of play areas.

15. The method in accordance with claim 10, wherein the shared bonus game element is a wheel.

16. The method in accordance with claim 10 further comprising adjusting the size of one of the play areas based on an in-game event.

17. The method in accordance with claim 10 further comprising adjusting the size of one of the play areas based on a ranking of a corresponding player in a multiplayer game.

18. The method in accordance with claim 10 further comprising executing a different wagering game at each of the adjacent ones of the play areas.

19. The method in accordance with claim 10, wherein the carousel electronic gaming machine further comprises a second display screen that encircles the carousel electronic gaming machine, wherein the method further comprises displaying a plurality of interactive consoles on the second display screen, wherein each interactive console of the plurality of interactive consoles corresponds to one of the play areas.

20. The method in accordance with claim 10 further comprising executing a bonus game on the circular display, wherein the bonus game affects each active play area.

* * * * *